US005501613A

United States Patent [19]

Lenoir

[11] Patent Number: 5,501,613

[45] Date of Patent: Mar. 26, 1996

[54] CONNECTOR ASSEMBLY INCORPORATING SUPERPOSED CONNECTION ELEMENTS

[75] Inventor: Michel Lenoir, Montfort le Gesnois, France

[73] Assignee: Framatome Connectors International, Courbevoie, France

[21] Appl. No.: 253,028

[22] Filed: Jun. 2, 1994

[30] Foreign Application Priority Data

Jun. 4, 1993 [FR] France ..... 93 06700

[51] Int. Cl.[6] ..... H01R 13/60

[52] U.S. Cl. ..... 439/540.1; 439/79

[58] Field of Search ..... 439/540, 540.1, 439/78, 79, 680, 607, 608, 609

[56] References Cited

U.S. PATENT DOCUMENTS

| | | | |
|---|---|---|---|
| 5,037,330 | 8/1991 | Fulponi et al. | 439/540.1 |
| 5,044,984 | 9/1991 | Mosser et al. | 430/540 |
| 5,080,609 | 1/1992 | Fabinan et al. | 439/540.1 |
| 5,085,590 | 2/1992 | Galloway | 439/540.1 |
| 5,167,531 | 12/1992 | Broschard, III et al. | 439/540 |
| 5,267,876 | 12/1993 | Rupert et al. | 439/540.1 |
| 5,318,463 | 6/1994 | Broschard, III et al. | 439/540 |
| 5,336,109 | 8/1994 | Hillbish | 439/540 |

FOREIGN PATENT DOCUMENTS

| | | | |
|---|---|---|---|
| 475199 | 3/1992 | European Pat. Off. . | |
| 1202036 | 8/1970 | United Kingdom | 439/540 |

*Primary Examiner*—William Briggs
*Attorney, Agent, or Firm*—Pollock, Vande Sande & Priddy

[57] ABSTRACT

A connection assembly comprising at least two superposed connection elements, i.e., an upper and a lower element, respectively, each of which comprises a housing, a central insulating body and a plurality of curved contacts arranged in the central insulating body, as well as stacking brackets which hold the connection elements in a determinate nominal superposed position. The stacking brackets are constituted by plates comprising an upper part incorporating a first position-retention element forcibly inserted into the upper connection element so as to form an attachment, and a lower part comprising a second position-retention element forcibly inserted into the lower connection element so as to form an attachment.

5 Claims, 1 Drawing Sheet

CONNECTOR ASSEMBLY INCORPORATING SUPERPOSED CONNECTION ELEMENTS

FIELD OF THE INVENTION

The present invention concerns a connection assembly of the type incorporating at least two superposed connection elements, i.e., an upper and lower element, respectively, each of which comprises a housing, a central insulating body in the housing, and a plurality of curved contacts arranged in the central insulating body, as well as superpositioning elements designed to hold the two connection elements in a given nominal superposed position.

BACKGROUND OF THE INVENTION

A connection assembly of the aforementioned type is disclosed in U.S. Pat. No. 5,167,531, in which the two superposed connection elements are housed in a molded metal body whose front surface incorporates holes in which are inserted rectangular front profile sections of the connection elements. The metal body comprises side walls serving, in particular, as means for holding in place the vertically-inserted shielded housing.

This structure yields a completely assembled connection unit. The spacing separating the two superposed connection elements is determined by the housings in the front surface of the molded metal housing.

On the other hand, it is not possible to produce subassemblies.

U.S. Pat. No. 5,044,984 also relates to a connection assembly for superposed connection elements. Its construction is complex, since it makes use of solid spacing elements incorporating completely specific shapes. Furthermore, this assembly requires additional components, which are absolutely necessary in order to make the assembly rigid.

SUMMARY OF THE INVENTION

The present invention concerns a connection assembly allowing the production of sub-assemblies, in particular modular subassemblies, but which embodies a simple structure and which, in addition, requires only a minimum number of modifications of the connection elements in order to bring about the desired result.

The invention thus relates to a connection assembly comprising at least two superposed connection elements, i.e., an upper and lower element, respectively, each of which incorporates a housing, a central insulating body within the housing, and a plurality of curved contacts arranged in the central insulating body, as well as superpositioning elements designed to hold in place the two connection elements in a determinate nominal superposed position. The superpositioning elements are formed by plates incorporating an upper part comprising at least one first position-retention element forcibly inserted in the upper connection element so as form an attachment, and a lower part comprising at least one second position-retention element forcibly inserted in the lower connection element, so as to form an attachment.

The first position-retention element belonging to at least one plate may advantageously embody a lug forcibly inserted into a matching hole in the housing of the upper connection element.

The upper part of at least one plate may advantageously comprise a first area forming a stop on an edge of the housing of the upper connection element.

The lower part of at least one plate may comprise a second area forming a stop on an edge of the housing of the lower connection element.

According to an especially advantageous embodiment, the first area forms a horizontal stop, while the second area forms a stop in at least the vertical dimension. This configuration ensures the rigidity of the assembly, while allowing the plates to be easily mounted by forcible insertion.

The second position-retention element of at least one plate may incorporate a second lug, which is forcibly inserted in a hole in the housing of the lower connection element.

The lower part of at least one plate may comprise a third position-retention element having a position-retention end extending beyond a lower surface of the housing of the lower connection element, so as to allow attachment of a medium through an opening.

The position-retention element may pass through the opening in the housing of the lower connection element.

The medium is, advantageously, a printed circuit to which at least some of the curved contacts are electrically connected.

The invention additionally concerns a superpositioning element for a connection assembly of the type comprising at least two superposed connection elements, i.e., an upper and lower element, this superpositioning element comprising a plate having an upper part incorporating at least a first position-retention element capable of being connected to the upper connection element by means of forcible insertion, and a lower part incorporating at least a second position-retention element capable of being attached to the lower connection element by means of forcible insertion.

BRIEF DESCRIPTION OF THE DRAWINGS

Other features and advantages of the invention will emerge from a reading of the following description, provided by way of example with reference to the attached drawings, in which.

DETAILED DESCRIPTION

Figure 1C:
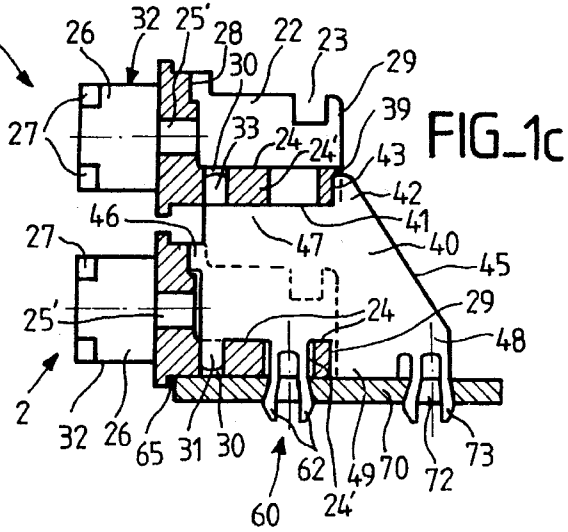
FIG. 1*c* is a cross-section along line A—A in FIG. 1*a;*.
Figure 1B:
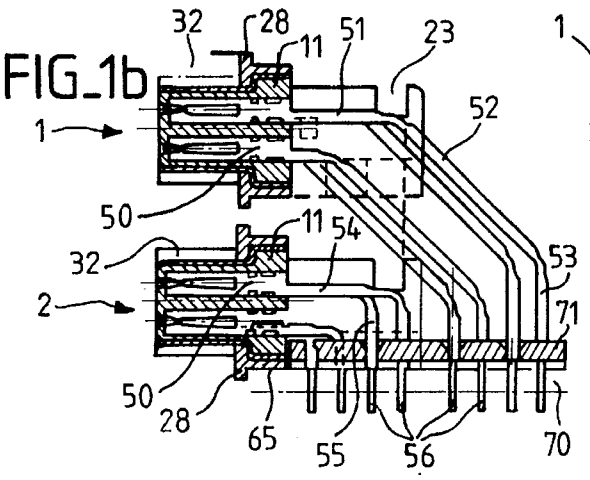
FIG. 1*b* is a cross-section along line B—B in FIG. 1*a;*

The drawings show that two connection elements 1 and 2 are superposed, element 1 having a housing 28 incorporating a front part 32 and in which an insulating body 11, is placed, in the holes of which are positioned female contacts 50 extended rearward, first, by a longitudinal section 51, an area 52 inclined by 45°, and a terminal area 53 perpendicular to the area 51, which is extended by contact ends 56 designed to be latched into holes 72 in a printed circuit 70, potentially across a position-retention plate 71. The lower connection element 2 incorporates, in similar fashion, a housing 28 in which an insulating body 11 is arranged, the holes 16 in which the contacts 50 are positioned, in this case female contacts which are extended rearward first by a longitudinal area 54, then by an area bent 90° in relation to the area 54, which is extended by contact terminations 56 designed to be clicked into holes 72 in a printed circuit 70.

Figure 2:
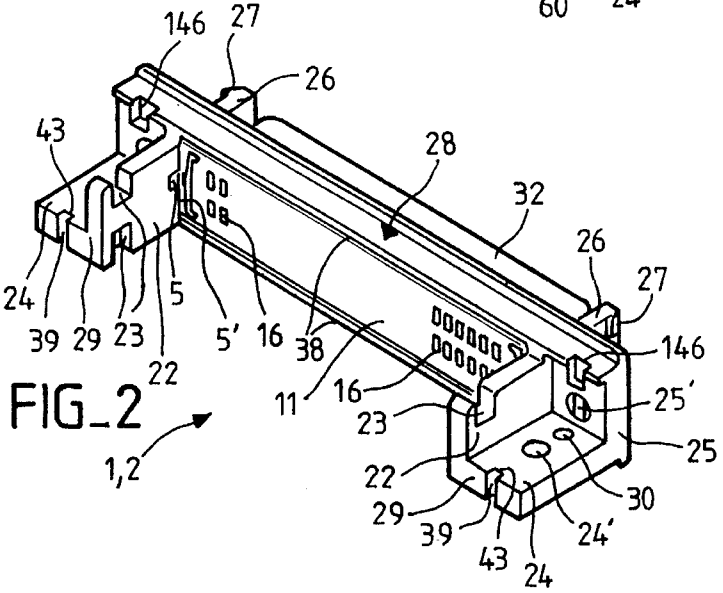
FIG. 2 is a perspective view of one of the connection elements used in FIGS. 1*a* to 1*c*.

As shown most notably in FIG. 2, in which the connection elements 1 and 2 are shown but with the contacts removed, the central insulating body 11 is held in position by an inclined surface 5 forming a stop for the beam-shaped terminal section 5' of the insulating body 11. The front part of the connection element comprises, at its longitudinal ends, extensions 26 shown at reference 27 which can be clicked in place in a front plate (not shown), which has a hole in which the front rectangular part 32' of the housing 28 is inserted.

Two areas forming a trihedron 22, 24, 25 are located to the rear of the connection elements 1 and 2 and at the longitudinal ends of the housing 28. The innermost wall of this trihedron is vertical and bears the reference 22. It embodies the sloping surface 5, as well as two U-shaped openings 23, one upper and the other lower, positioned near the rear of the wall 2. The horizontal wall 24 of the trihedron incorporates an orifice 24' and an orifice 30 located between the orifice 24' and the vertical wall 25 of the trihedron, and, finally, a vertical slot 39 placed to the rear of the wall 24. The slot and the orifice 24' and 30 advantageously have a common axis. Finally, the vertical wall 25 of the trihedron incorporates a circular opening 25'. It will be noted that the openings 24' and 25' already exist in connectors of this type.

Figure 1A:
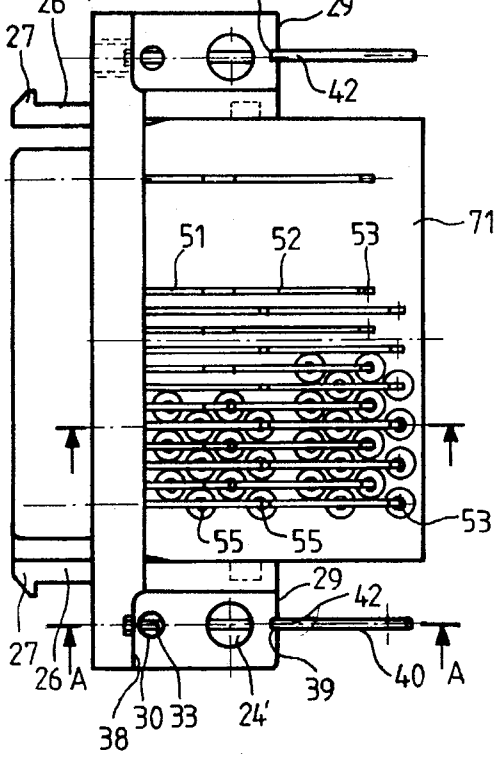
FIG. 1*a* is a top plan view of a connection assembly according to a preferred embodiment of the invention.

As shown more especially in FIGS. 1*a* and 1*c*, elements 1 and 2 are held in their superposed position by two substantially flat plates 40, each of which is arranged at one longitudinal end of the housings 28. Each of the plates thus comprises, at an upper end 47, first, an extension 33 capable of being forcibly inserted through the lower part of the hole 30 in the wall of the trihedron 24, and a rear extension 42 which is forcibly lodged in the bottom 43 of a vertical groove 39.

On the lower part, the plate is also positioned, first, by the finger or lug 31 forcibly inserted into the opening 30, and also by the extension 29 forcibly inserted into a vertical groove 39 constituting a stop laterally. Furthermore, an extension 46 may be supported at the upper part of the housing 28, and, in particular, it may be housed in a groove 146 constituting a stop laterally.

The plate 40 whose lower part 48 adjoins the upper edge of the portion of the trihedron 24 makes it possible, not only to maintain a vertical space between elements 1 and 2, but also to position these elements in the other directions, while imparting to the assembly the character of a modular sub-assembly.

The housing 28 of the connector is held, first, vertically, because of the fact that, since its lug 33 is forcibly pressed into the opening 30, the upper edge 41 of the plate extends along the lower surface of the portion of the trihedron 24; and second, in a front-to-back position by virtue of the fact that the housing 28 is grasped between the extension, or lug, 33 and the extension 42; and finally, in an angled configuration in a horizontal plane because of the presence of the two grooves 39 and the two grooves 146, which hold and confine the extensions 29 and 42.

In its lower part 48, the plate also incorporates elements 62 forming an elastic fork which is inserted into the printed circuit 70 while passing first through the openings 24' in the housing 28 of the element 2 and the openings 72 of the printed circuit 70.

After the insertion of the forks 62 into the openings 72 of the printed Circuit, the assembly is looked in position by virtue of the fact that the fork arms 73 snap into place. Moreover, the lower part 48 of the plate 40 comprises an extension 49 which is stopped against the upper surface of the printed circuit 70, at the same level as the lower surface 65 of the housing 38 of the element 2.

It will be noted that, in its rear part, the plate 40 incorporates an inclined part 45 extending from the extension 42 to the rear fork 60. This part 45 may be used advantageously to house therein, e.g., in grooves, a cover extending over the entire length of the connector.

The plate 40 can be grounded, thereby allowing the connection assembly to be shielded at least partially.

We claim:

1. A stacked electrical connector assembly comprising:

(a) upper and lower electrical connection elements each having a housing incorporating a front part in which front part is placed an insulating body receiving contacts, said housing having longitudinal ends provided with areas comprising a vertical innermost wall, a horizontal wall and a front wall;

(b) stacking brackets comprising an upper end part engaging a lower part of said upper connection element and a lower end part engaging an upper part of said lower electrical connection element;

(c) said upper end part of said stacking brackets comprising a vertically protruding lug to be force-fitted into an opening of said horizontal wall of said upper connection element, said upper end part further comprising a rear extension to be force-fitted in a rear slot of said horizontal wall;

(d) said lower end part of said stacking brackets comprising at least one downwardly protruding lug to be force-fitted in an opening of said horizontal wall of said lower connection element; and (e) said lower end part further comprising a rear extension to be force-fitted in a rear slot of said horizontal wall.

2. The stacked electrical connector assembly according to claim 1, wherein said stacking brackets are formed by plates, and wherein said lower end part of at least one of said plates incorporates an area forming a stop at least vertically against an edge of said housing of said lower connection element.

3. The stacked electrical connector assembly according to claim 2, wherein an upper part of said plates comprises an area forming a horizontal stop against an edge of said housing of said upper connection element.

4. The stacked electrical connector assembly according to claim 2, wherein a lower part of at least one plate incorporates a position-retention element comprising at least two projections extending through openings in and beyond a lower surface of said housing of said lower connection element, so as to allow a printed circuit to be attached thereto.

5. The stacked electrical connector assembly according to claim 4, wherein said lower part of said plate comprises an extension which is stopped against an upper surface of said printed circuit, said extension being disposed between said at least two projections.

* * * * *